United States Patent [19]

Spoormaker

[11] Patent Number: 4,531,454

[45] Date of Patent: Jul. 30, 1985

[54] AIR CONDITIONING SYSTEM

[76] Inventor: Hendrik J. Spoormaker, 158 Dorado St., Waterkloof Ridge, Pretoria, Transvaal, South Africa

[21] Appl. No.: 640,657

[22] Filed: Aug. 14, 1984

[30] Foreign Application Priority Data

Aug. 29, 1983 [ZA] South Africa ..... 83/6390

[51] Int. Cl.[3] ..... G03F 7/24

[52] U.S. Cl. ..... 98/31.6; 98/33.1; 165/50

[58] Field of Search ..... 98/33 R, 40 D, 38 E, 98/38 F; 165/50

[56] References Cited

U.S. PATENT DOCUMENTS

| | | | |
|---|---|---|---|
| 2,702,503 | 2/1955 | Wildhaber | 98/33 R |
| 3,354,947 | 11/1967 | McKinnon | 98/33 R |
| 3,824,987 | 7/1974 | Howorth | 98/33 R |

*Primary Examiner*—Ronald C. Capossela

[57] ABSTRACT

A fan coil unit 13 is mounted in an underfloor plenum with its intake 14 flush with the floor. The unit 13 feeds fan air terminals 11 and 12 each of which has an aperture 26 which vents air into the plenum space when the fan of the relevant unit is not running and through which air may be drawn from the plenum space when the unit 13 is not operating.

2 Claims, 3 Drawing Figures

FIG_1
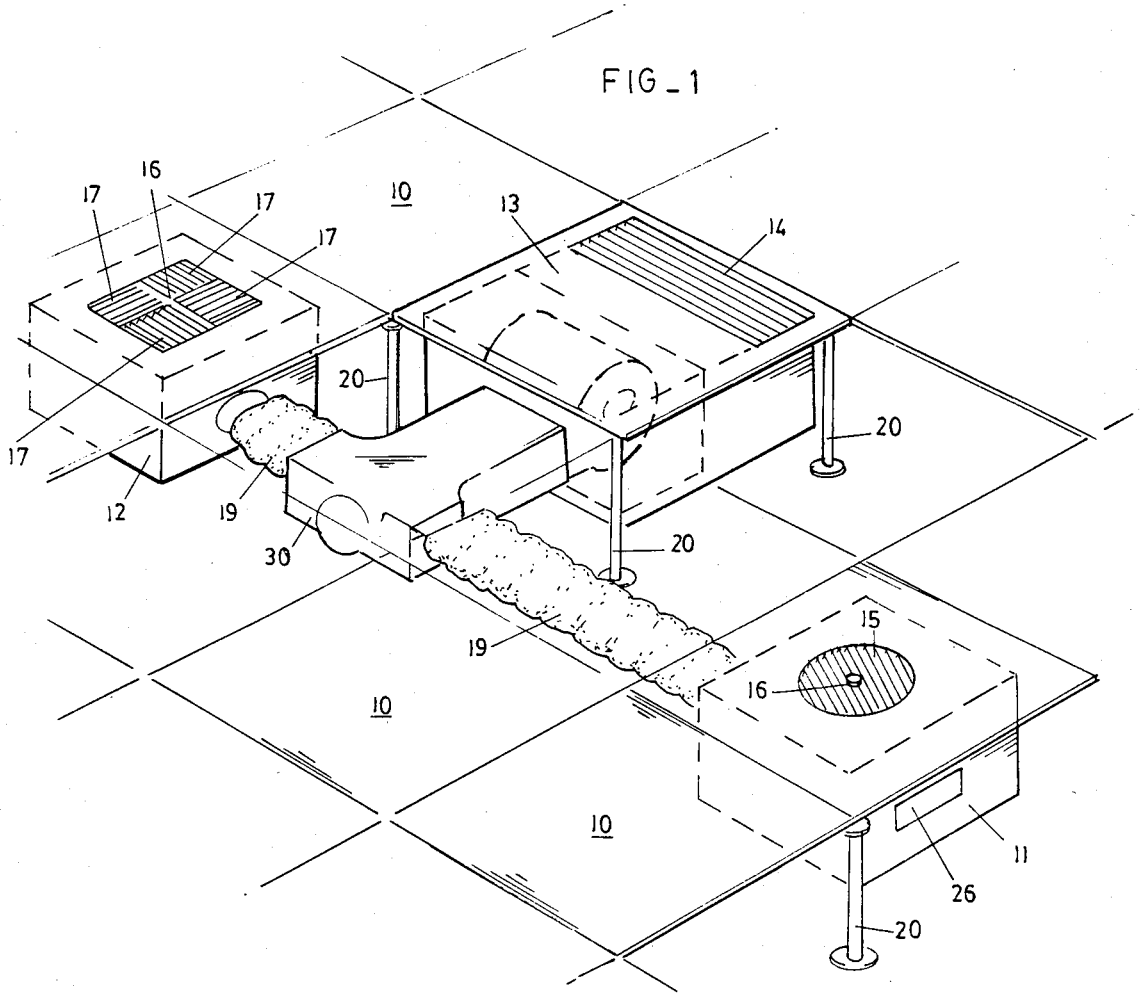
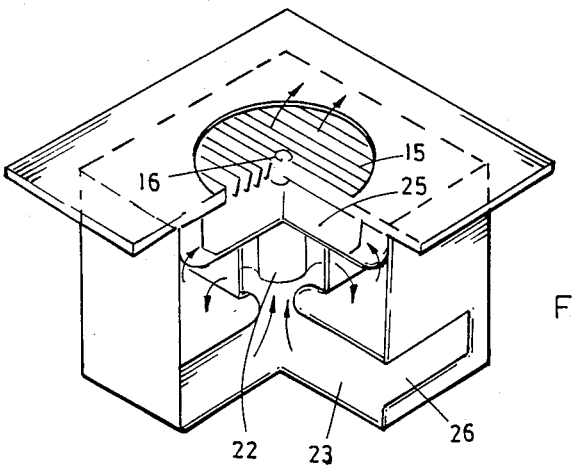
FIG_2

AIR CONDITIONING SYSTEM

BACKGROUND TO THE INVENTION

This invention relates to air conditioning systems.

It is an object of the invention to provide a system which in a reasonably inexpensive manner can provide for individual workstation comfort control.

SUMMARY OF THE INVENTION

According to the invention in a building with a floor tile covered underfloor plenum an air conditioning system comprises:

at least one air conditioning unit with its intake and top in the same plane as the floor tiles;

flexible ducts leading from the air conditioning unit;

at the end of each flexible duct a fan air terminal with its outlet and top in the same plane as the floor tiles; and means for so connecting each fan air terminal to a duct that the conditioned air is discharged into the plenum when the fan air terminal is switched off while the air conditioner is operating and the fan air terminal can draw air from the plenum when the air conditioner is not operating.

The air conditioner is preferably a treated water fan coil unit. By "treated" is meant that the water is either heated or chilled as circumstances may require.

Each individual fan coil unit should have controls for switching it on or off and each fan air terminal controls for either switching on-off or for changing fan speed combined with the facility of directing the air flow, operable from its exposed surface.

DESCRIPTION OF THE DRAWINGS

FIG. 1 is a perspective view of a floor section of a room with an underfloor plenum covered by tiles;

FIG. 2 is a perspective view with parts broken away of a discharge unit.

DESCRIPTION OF EMBODIMENTS

Figure 3:
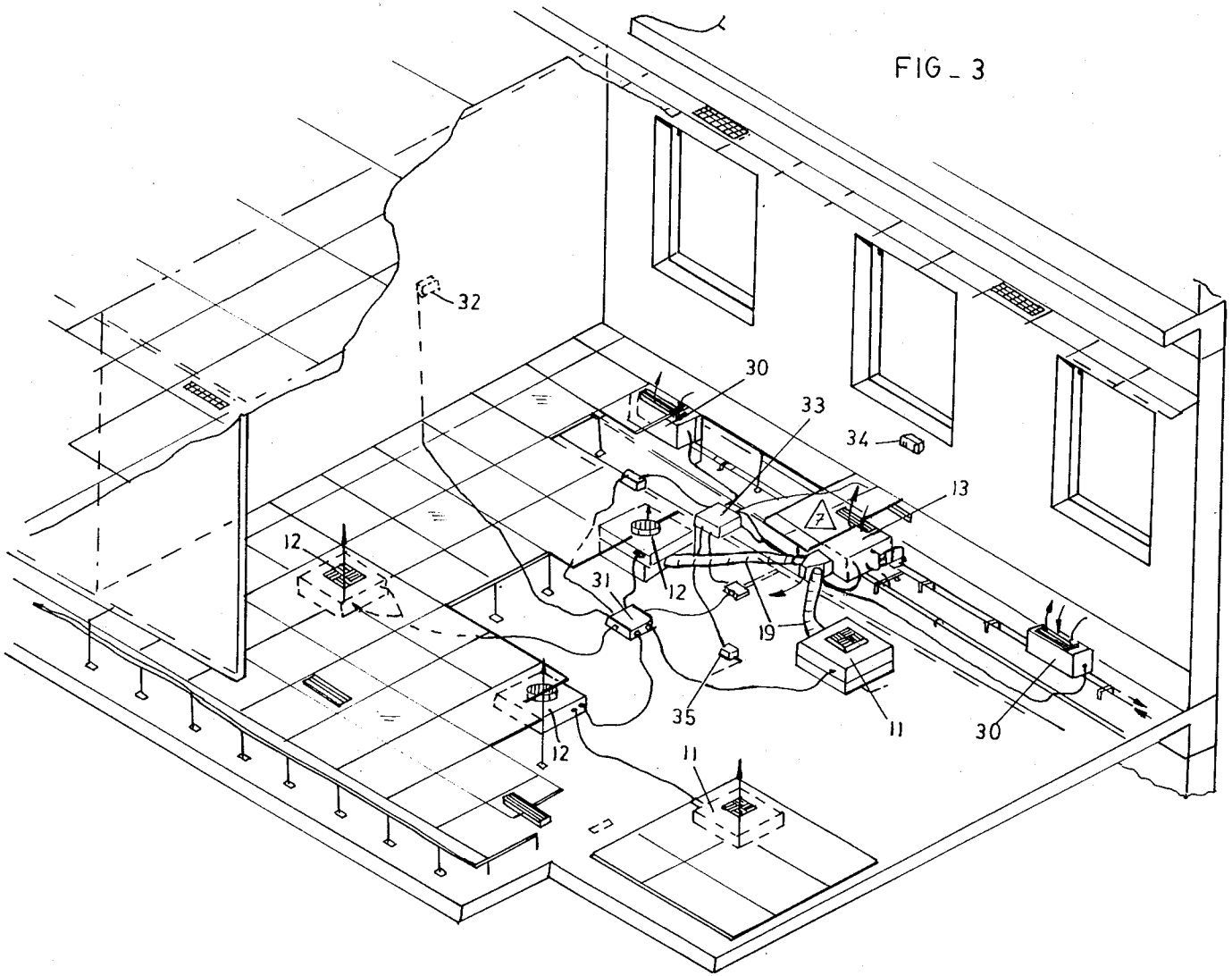
FIG. 3 is a diagrammatic view of a more complete system.

FIG. 1 shows a floor composed of a series of tiles 10 mounted above a base to provide an underfloor plenum in the usual way. As shown, three tiles have been replaced by the top surfaces of units used for air conditioning. There are two discharge units 11 and 12 and an intake unit 13.

The unit 13 has an air intake opening 14 flush with the floor formed by the tiles 10. The unit 11 has a circular outlet opening 15 with inclined vanes which can be rotated about a central recessed control knob 16 for controlling the speed and the on/off condition of the unit 11, which is a fan unit as described below.

The unit 12 has four square sections 17 of adjustable inclined vanes and a central control knob 16.

Ducts 19 connect the units 11 and 12, which need not be in the same room, to the unit 13 which has a fan drawing air from the intake openfing 14 over water coils to a T-piece 30 connected to the ducts 19.

The units 11, 12 and 13 are supported by adjustable pedestals 20, of which only some are shown, off the floor slab.

A fan unit 11 is illustrated in FIG. 2. The unit has a radial fan 22 drawing air from a chamber 23 and discharging the air peripherally into a space 25 below the outlet opening 15. The chamber 23 is connected to a duct 19 as shown in FIG. 1. An aperture 26 vents air in the chamber 23 to the plenum space, but the size of the aperture is such that when the fan 25 is running, the latter draws air preferentially from the chamber 23. However, if the fan 25 is not running, the air flowing along the duct 19 escapes through the apertures 26 into the plenum space to condition that space, i.e. the air will give up cold or heat to the materials bounding the plenum space.

If the unit 13 is shut off, and the fan 25 is running, air is drawn from the plenum space into the unit 11 and discharged into the working area.

The unit 12 is also fitted with an aperture 26, but this is not shown in the drawing. Its fan also draws air preferentially from its duct 19.

In FIG. 3 a room has in its underfloor plenum an air conditioning unit 13 fed with chilled water. There are also fan air terminals 11 and 12. In addition fan heaters 30 are provided. At the other end of the room there are terminals 11 and 12 which are not connected to any ducts 19 but draw air directly from the underfloor plenum whenever they are switched on.

All fan air units are controlled from a control box 31 which is under the control of a room thermostat 32. If the room temperature falls to too low a level the fan air terminals are all switched off. Another control box 33 controls the unit 13 and the fan heaters 30. A room thermostat 34 and a plenum thermostat 35 control the box 33 so that the room and the plenum may not be overheated or cooled to too low a temperature.

I claim:

1. An air conditioning system for a building with a plurality of floor tiles covering an underfloor plenum, comprising:

an air conditioning unit with an intake and an outlet, the intake being in substantially the same plane as the floor tiles, the air conditioning unit having an operating mode and a nonoperating mode, the air conditioning unit producing conditioned air at the outlet when the air conditioning unit is in the operating mode;

a plurality of flexible ducts, each duct having a first end and a second end, each first end being connected to the outlet of the air conditioning unit; and a plurality of fan air terminals, each fan air terminal including an inlet, an outlet, and an aperture, the inlet of a fan air terminal being connected to the second end of a flexible duct, the outlet of a fan air terminal being in substantially the same plane as the floor tiles, each fan air terminal having an on mode and an off mode, each aperture being sized to discharge conditioned air into the plenum when the air conditioning unit is in the operating mode and the associated fan air terminal is in the off mode and to draw air from the plenum when the air conditioning unit is in the nonoperating mode and the associated fan air terminal is in the on mode.

2. The system claimed in claim 1 in which the air conditioner is a treated water fan coil unit.

* * * * *